US011519611B2

(12) United States Patent
Gauthier et al.

(10) Patent No.: US 11,519,611 B2
(45) **Date of Patent: *Dec. 6, 2022**

(54) RANGE HOOD INSTALLATION SYSTEM

(71) Applicant: Broan-NuTone LLC, Hartford, WI (US)

(72) Inventors: Benoit Gauthier, St-Cyrille (CA); Richard R. Sinur, West Bend, WI (US); Brian R. Wellnitz, Grafton, WI (US); Jonathan Houde, Drummondville (CA); Remi Cossette, Drummondville (CA); Yannick Morin, Quebec (CA); Mark Kurth, La Porte, IN (US); Peter Muller, Chicago, IL (US); Timothy Payne, Chicago, IL (US); David Wylen, Chicago, IL (US); Phil Anthony, Chicago, IL (US); Aaron Eiger, Chicago, IL (US); Scott Rote, Mokena, IL (US)

(73) Assignee: Broan-NuTone LLC, Hartford, WI (US)

( * ) Notice: Subject to any disclaimer, the term of this patent is extended or adjusted under 35 U.S.C. 154(b) by 60 days.

This patent is subject to a terminal disclaimer.

(21) Appl. No.: 16/688,181

(22) Filed: Nov. 19, 2019

(65) Prior Publication Data

US 2020/0158348 A1 May 21, 2020

Related U.S. Application Data

(63) Continuation of application No. 15/159,571, filed on May 19, 2016, now Pat. No. 10,539,329.
(Continued)

(51) Int. Cl.
*F24C 15/20* (2006.01)

(52) U.S. Cl.
CPC ..... *F24C 15/2028* (2013.01); *F24C 15/2071* (2013.01)

(58) Field of Classification Search
CPC ..... F24C 15/2028; F24C 15/2071; F24C 15/2042; F16M 13/02
See application file for complete search history.

(56) References Cited

U.S. PATENT DOCUMENTS 3,098,423 A 7/1963 Giannini
4,011,803 A * 3/1977 Pfaffinger ..... A47B 77/08 126/299 R (Continued)

FOREIGN PATENT DOCUMENTS

CN 201363810 12/2009
EP 2827067 1/2015

(Continued)

OTHER PUBLICATIONS

US 5,961,265 A, 10/1999, Postadan (withdrawn)

(Continued)

*Primary Examiner* — Alfred Basichas
(74) *Attorney, Agent, or Firm* — Barnes & Thornburg LLP

(57) ABSTRACT

A mounting bracket mountable to the underside of the cabinet prior to the range hood and configured to engage and support the range hood as the range hood is secured to the cabinet. The mounting bracket having a support feature engagable to the range hood to hold the range hood proximate the cabinet while fasteners are sunk to secure the range hood to the cabinet. The mounting brackets are pre-positioned on the cabinet such that range hood is aligned with the cabinet when the range hood is supported by the support feature. The smaller mounting brackets can be more easily mounted in the proper position on the cabinet then the larger (Continued)

range 10 hood speeding the installation process and reducing errors.

5 Claims, 18 Drawing Sheets

Related U.S. Application Data

(60) Provisional application No. 62/163,769, filed on May 19, 2015.

(56) References Cited

U.S. PATENT DOCUMENTS

| | | | | |
|---|---|---|---|---|
| 4,133,300 | A | 1/1979 | Burton, Jr. et al. | |
| 4,614,177 | A | 9/1986 | Buckley et al. | |
| 4,628,185 | A * | 12/1986 | Norwood | A47J 37/0623 219/386 |
| 5,961,264 | A | 10/1999 | Postadan | |
| 6,470,880 | B1 | 10/2002 | Chang | |
| 9,897,331 | B2 * | 2/2018 | Bruin-Slot | F24F 13/0254 |
| 10,539,329 | B2 * | 1/2020 | Gauthier | F24C 15/2071 |
| 2006/0042622 | A1 | 3/2006 | Searer | |
| 2007/0099558 | A1 | 5/2007 | Oagley et al. | |
| 2007/0256681 | A1 * | 11/2007 | Chiang | F24C 15/2071 126/299 R |
| 2010/0206292 | A1 * | 8/2010 | Tsakiris | F24C 15/2092 126/299 F |
| 2012/0018246 | A1 | 1/2012 | Pietro et al. | |
| 2014/0352132 | A1 | 12/2014 | Bruin-Slot et al. | |
| 2014/0352151 | A1 | 12/2014 | Bruin-Slot et al. | |
| 2015/0047198 | A1 | 2/2015 | Bruin-Slot et al. | |
| 2015/0114384 | A1 | 4/2015 | Bruin-Slot | |
| 2016/0341432 | A1 | 11/2016 | Sinur et al. | |
| 2017/0191674 | A1 * | 7/2017 | Brockman | F24C 15/2042 |

FOREIGN PATENT DOCUMENTS

| | | |
|---|---|---|
| JP | 2004263908 | 9/2004 |
| JP | 5996889 | 9/2016 |
| WO | WO2016187460 | 11/2016 |
| WO | WO2016187467 | 11/2016 |

OTHER PUBLICATIONS

Office Action issued to Canadian Patent Application No. 2,968,444, dated Aug. 3, 2021 (4 pages).
Office Action in related Chinese Application No. 201680036079.0; dated Jul. 5, 2019 (4 pages).
Office Action as issued in Corresponding Chinese Patent Application No. 201680042446.8; dated Dec. 5, 2018 (8 pages).
English Translation of portions of Dec. 5, 2018 Office Action in Chinese Patent Application No. 201680042446.8 (5 pages).
International Application Serial No. PCT/US2016/033340, International Search Report dated Aug. 30, 2016 (2 pages).
International Application Serial No. PCT/US2016/033340, Written Opinion dated Aug. 30, 2016 (7 pages).
International Application Serial No. PCT/US2016/033349, International Search Report dated Aug. 22, 2016 (2 pages).
International Application Serial No. PCT/US2016/033349, Written Opinion dated Aug. 22, 2016 (6 pages).
Wilson Tool "Trumpf-Style Special Tooling" 2006 Catalogue (37 pages).
Wilson Tool "Thick Turret Special Tooling" Jun. 2015 Catalogue (40 pages).

* cited by examiner

RANGE HOOD INSTALLATION SYSTEM

CLAIM OF PRIORITY

This patent application claims the benefit of priority, under 35 U.S.C. Section 119(e), to Rick Sinur et al. U.S. patent application Ser. No. 15/159,571, entitled "RANGE HOOD INSTALLATION SYSTEM," filed on May 19, 2016, which claims the benefit of Provisional U.S. Patent Application Ser. No. 62/163,769, entitled "MODULAR RANGE VENT HOOD," filed on May 19, 2015, each of which is hereby incorporated by reference herein in its entirety.

TECHNICAL FIELD

This document pertains generally, but not by way of limitation, to systems and related methods for modular installation of range vent hoods.

BACKGROUND

Under cabinet range hood installation often require complex installation including fitting of the specific range hood to the underside of the cabinet; preparing mounting locations on the cabinet for fasteners; aligning and connecting ducting to the hood, and electrically connecting the hood to the building wiring. The fitting of range hoods to specific cabinets and the multi-step alignment and installation process presents numerous challenges for manufacturers and installers.

The initial difficulty is fitting the range hood to the particular dimensions and construction of the particular cabinet. While range hood dimensions and construction are standardized for large scale manufacturing purposes, cabinet dimensions and construction are typically not standardized. The range hood to be installed must account for different cabinet depths, which are commonly 12 or 15 inches deep. Similarly, range hoods must be mountable to the underside of cabinets, which can have different constructions and shapes. The underside of cabinets are typically of a "European" frameless construction or a "framed" construction having a recessed bottom panel. For a framed cabinet, shims or blocks must be positioned within the recess to provide a flush mounting surface for the range hood. As the depth of the recessed panel can be non-standard or non-uniform, the process of manufacturing the flush mounting surface can be time consuming and require additional materials that the installer may not have on-hand.

In addition to fitting the range hood with the dimensions and construction of the particular cabinet, the range hood must be properly aligned with the mounting features on the cabinet. The mounting features must be attached to the cabinet in proper positions to align with corresponding features on the range hood. Upon fitting the range hood to the cabinet, the mounting feature must be removed and repositioned if the mounting features are found to be in the wrong position. Similarly, the range hood must also be aligned and connect with the ducting, which has limited side-to-side and up-and-down movement for alignment with the ducting. The weight and large dimensions of the range hood can make handling the range hood into engagement with the cabinet and supporting the weight of range hood difficult. Similarly, the range hood must also be supported while the necessary electrical connections are made. In order to safely mount the range hood, two or more people are often required to safely mount the range hood and make the necessary connections as at least one installed must be handling and supporting the range hood throughout the mounting process.

The complexity of attaching the range hood to the cabinet can present numerous challenges for manufacturers and installer, which can make installation difficult

OVERVIEW

The present inventors have recognized, among other things, that a problem to be solved can include fitting large and awkwardly shaped range hoods to underside mounting surfaces of cabinets. In an example, the present subject matter can provide a solution to this problem, such as by a mounting bracket that can be mounted to the underside of the cabinet prior to the range hood to hold the range hood proximate the cabinet as the range hood as at least one fastener is inserted through the range hood to secure the range hood to the cabinet. The mounting bracket can have a support feature engagable to the range hood to temporarily hold the range hood proximate the cabinet while fasteners are sunk to secure the range hood to the cabinet. In this configuration, an installer can mount the range hood to the cabinet or make ducting and electrical connections without supporting the entire weight of the range hood or requiring the assistance of another installer or other mechanism to support the range hood weight.

In an example, the support feature can be inserted through an opening in the range hood to hook the range hood such that the range hood can be lifted and engaged to the support feature without tools or separate fasteners. The mounting brackets can be positioned on the cabinet such that range hood is aligned with the cabinet when the range hood is supported by the support feature. The smaller mounting brackets can be more easily mounted in the proper position on the cabinet than the larger range hood, speeding the installation process and reducing errors.

In an example, the mounting bracket can have a base portion including at least one support feature engagable to the range hood. The base portion can define at least one hood opening for receiving a fastener to secure the range hood to the mounting bracket or guide the fastener through the base portion and into engagement with the cabinet. As pilot holes are often required to sink the fasteners for securing the range hood to the cabinet, the hood openings in the base portion can serve as a guide for drilling the pilot holes. The base portion can define at least one bracket opening for receiving a fastener to secure the mounting bracket to the cabinet. In frameless cabinets, the base portion can be mounted to the underside of the frame. The mounting bracket can have a trim tab oriented transverse to the base portion. The trim tab can be mounted to a frame of a framed cabinet such that the base portion can be oriented parallel to the underside of the frame and flush with the edge of the frame. This configuration provides a flush mounting surface for the range hood.

This overview is intended to provide an overview of subject matter of the present patent application. It is not intended to provide an exclusive or exhaustive explanation of the present subject matter. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 1 OB is a perspective view of the adjustable spacer depicted in Figure IGA being mounted on an upper surface of a range hood and a spacer segment being removed to alter the effective height of the spacer element according to an example of the present disclosure.

Figure IOC is a perspective view of a range hood on which a plurality of spacers are mounted on an upper surface of the range hood according to an example of the present disclosure.

Figure 10A:
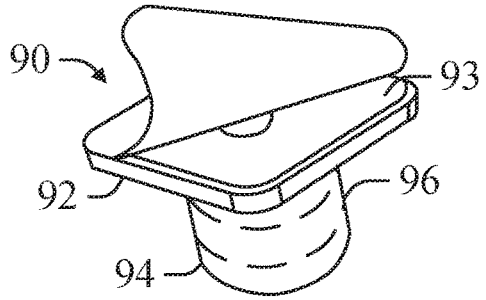
FIG. 10A is a perspective view of an adjustable spacer mountable on an upper surface of a range hood according to an example of the present disclosure.
Figure 10B:
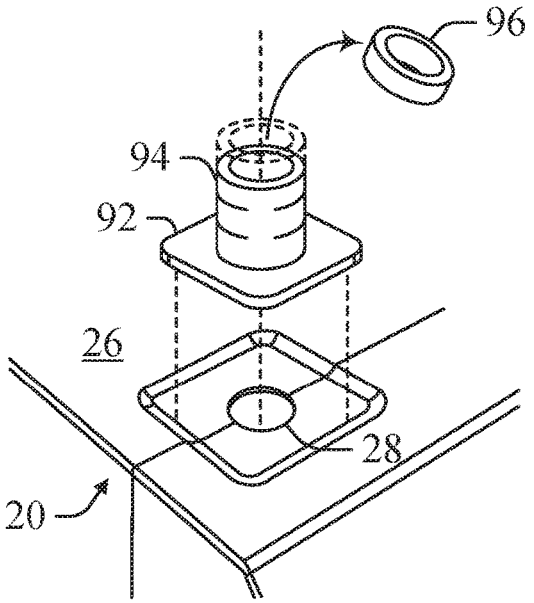
Figure 10C:
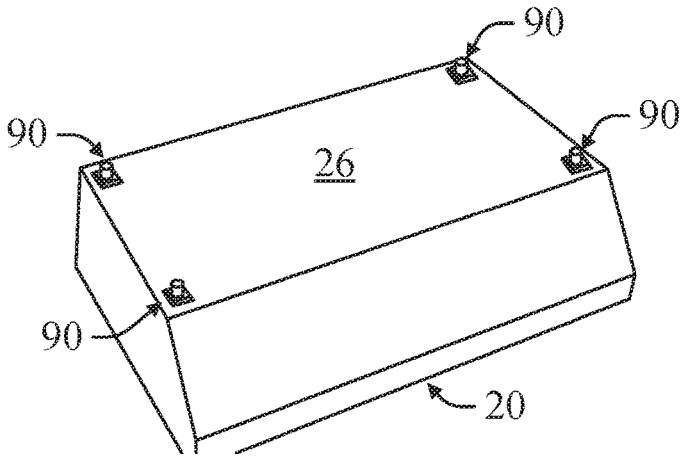
Figure 10D:
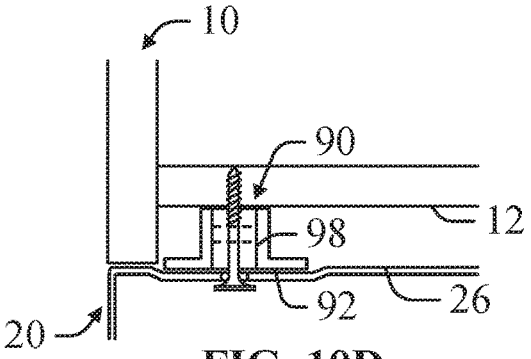

FIG. 10D is a side view of a spacer element mounted on an upper surface of the range hood and receiving a fastener to couple the range hood to a cabinet according to an example of the present disclosure.

Figure 11A:
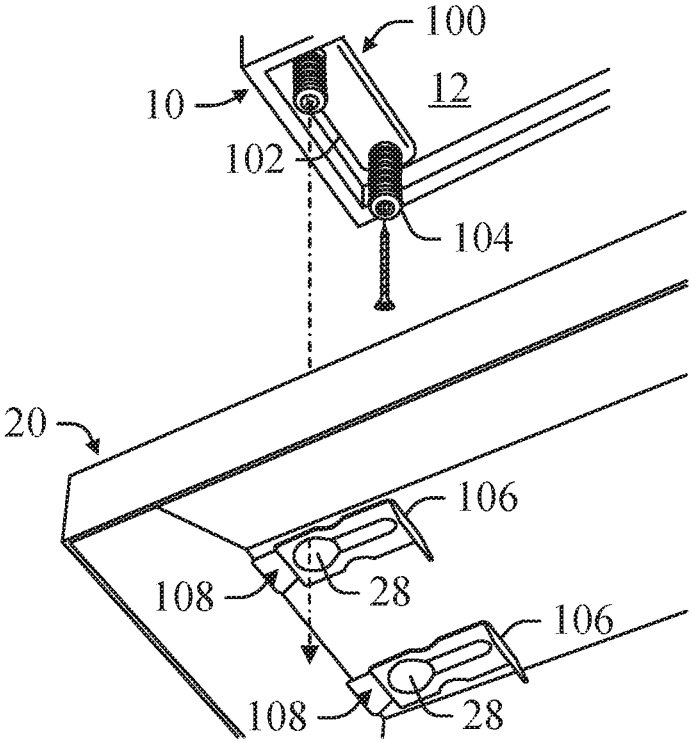

FIG. 11A is a perspective view' of a mounting bracket mountable on a cabinet and having slotted studs engagable by a slider mounted on a range hood to couple the range hood to the cabinet according to an example of the present disclosure.

Figure 11B:
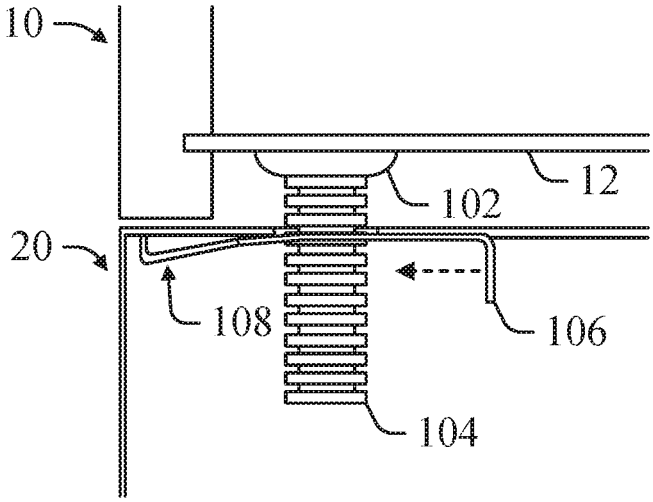

FIG. 11B is a side view of the slotted stud of the mounting bracket depicted in FIG. '12A being inserted through the mounting bracket and engaged by the slider to couple a range hood to a cabinet according to an example of the present disclosure.

Figure 12A:
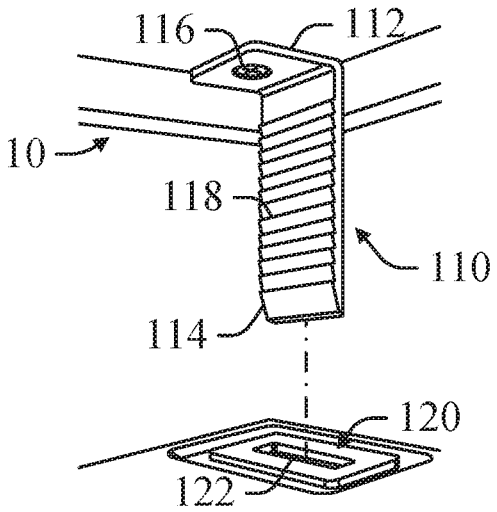

FIG. 12A is a perspective view of a mounting bracket having a mounting tab including a plurality of angled notches engagable by a mounting bracket of a range hood according to an example of the present disclosure.

Figure 12B:
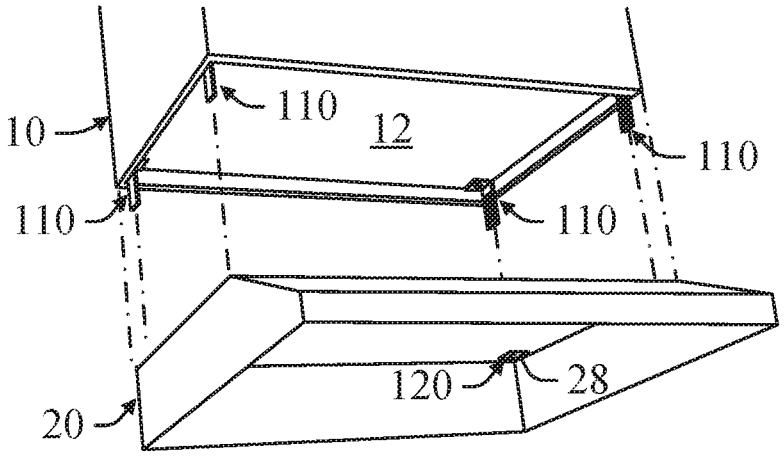

FIG. 12B is a perspective view of a range hood being coupled to a cabinet with a plurality of mounting brackets depicted in FIG. 12A according to an example of the present disclosure.

Figure 12C:
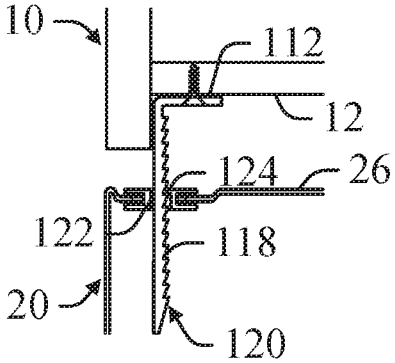

FIG. 12C is a side view 7 of the mounting tab of the mounting bracket depicted in FIG. 12A being inserted through the mounting bracket according to an example of the present disclosure.

Figure 12D:
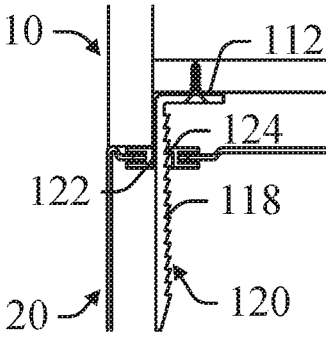

FIG. 12D is a side view of the mounting tab of the mounting bracket depicted in FIG. 12A being inserted through the mounting bracket to couple a range hood to a cabinet according to an example of the present disclosure.

Figure 13A:
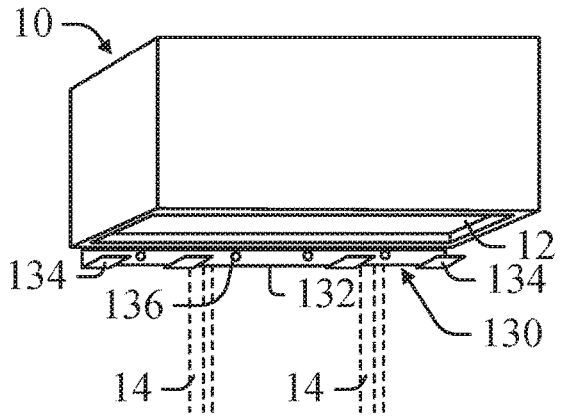

FIG. 13A is a perspective view of a mounting bracket having a base portion and a plurality of mounting tabs mounted beneath a cabinet according to an example of the present disclosure.

Figure 13B:
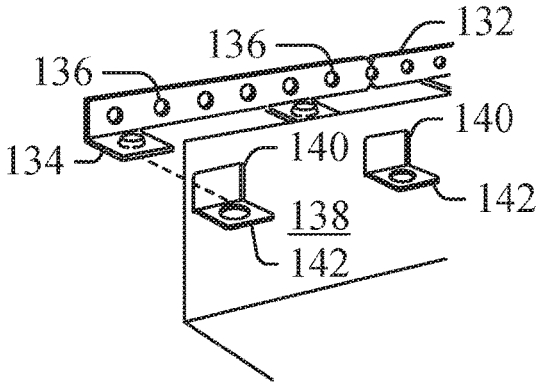

FIG. 13B is a perspective view of the mounting bracket depicted in FIG. 13A wherein a range hood is be positioned against the mounting bracket such that the mounting tabs are inserted through bracket openings in the rear of the range hood according to an example of the present disclosure.

Figure 13C:
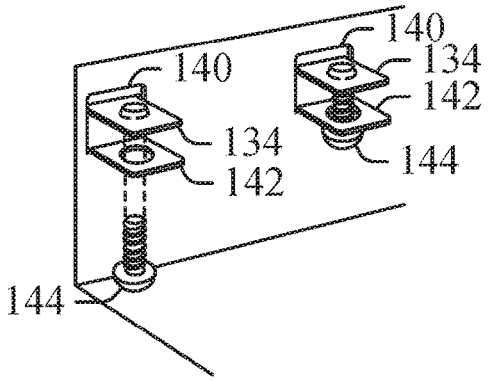

FIG. 13C is a perspective view of the mounting bracket depicted in FIG. 13A wherein the mounting tabs are pulled against corresponding hood tabs by fasteners according to an example of the present, disclosure.

Figure 13D:
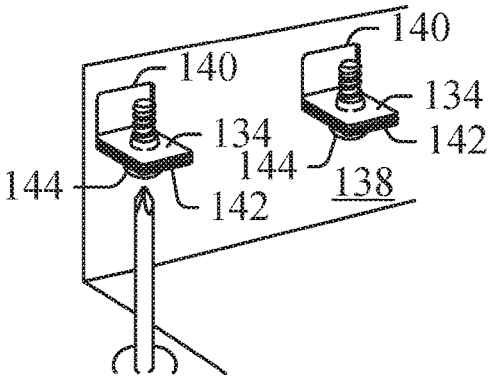

FIG. 13D is a perspective view of the mounting bracket depicted in FIG. 13A wherein the mounting tabs are coupled to the hood tabs by fasteners according to an example of the present disclosure.

Figure 13E:
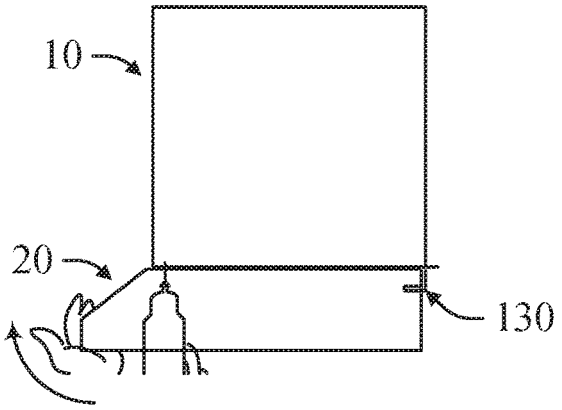

FIG. 13E is a schematic view illustrating supporting a base portion of a range hood with the mounting bracket depicted in FIG. 13A to pivot a nose portion of the range hood for receiving fasteners to mount the range hood to the cabinet according to an example of the present disclosure.

Figure 14A:
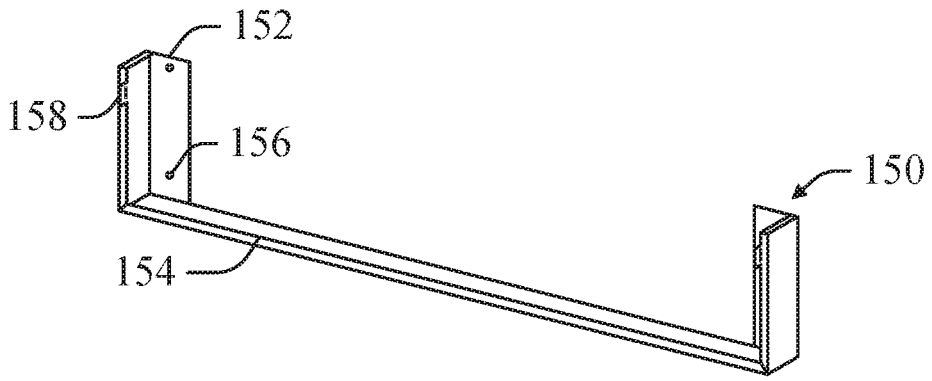

FIG. 14A is a perspective view of a mounting bracket having a mounting portion and a support bracket according to an example of the present disclosure.

Figure 14B:
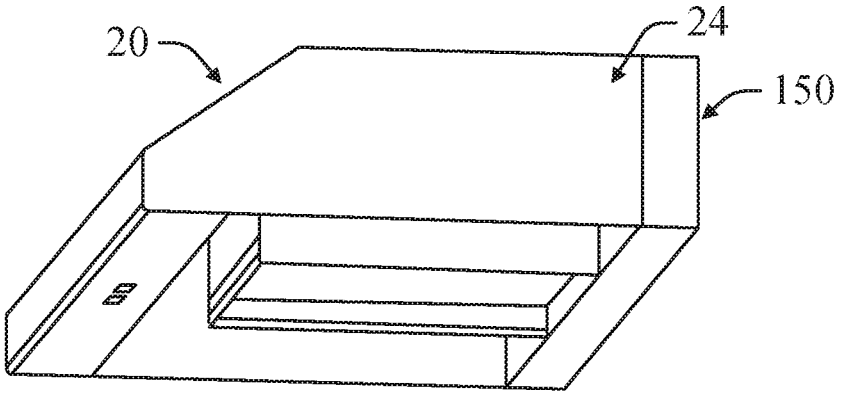

FIG. 14B is a perspective view of the mounting bracket depicted in FIG. 14A fitting to a base portion of a range hood according to an example of the present disclosure.

Figure 14C:
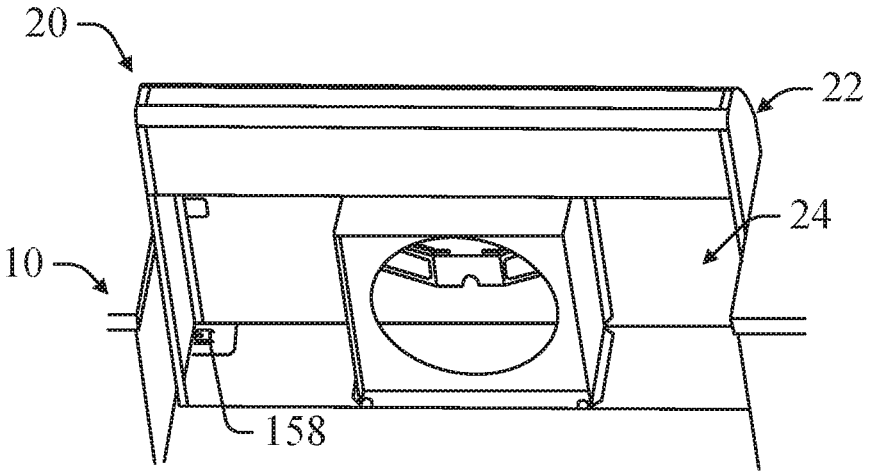
Figure 15A:
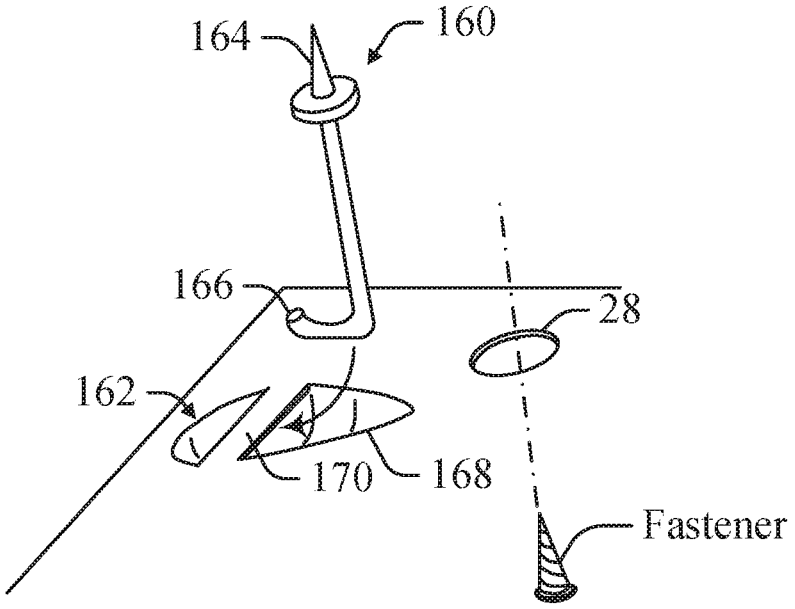

FIG. 14C is a perspective view of engagement tabs of the mounting bracket depicted in FIG. 14A inserted through corresponding slots of the range hood to couple the mounting bracket to the range hood according to an example of the present disclosure FIG. 15A is a perspective view of a mounting hook that can coupled to a support feature on a range to support the range hood for insertion of fasteners through the mounting features according to an example of the present disclosure.

Figure 15B:
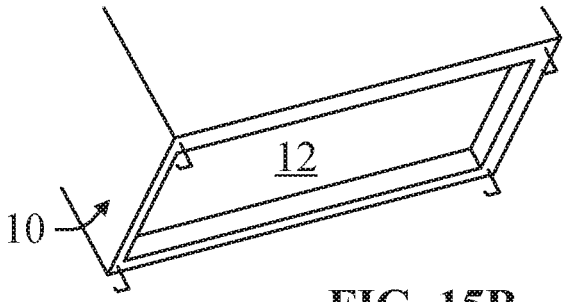

FIG. 15B is a perspective view of a cabinet on which a plurality of mounting hooks are mounted according to an example of the present disclosure.

Figure 16A:
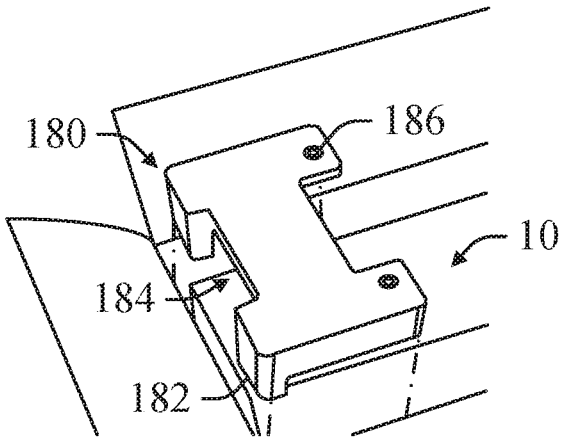

FIG. 16A is a perspective view of a packing shim according to an example of the present disclosure.

Figure 16B:
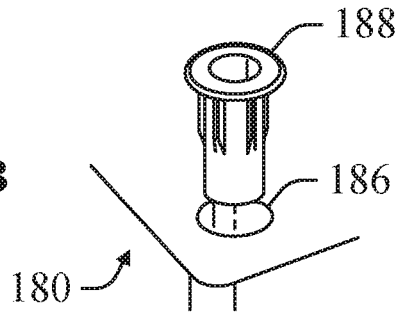

FIG. 16B is a perspective view of a fastener anchor insertable into a packing shim according to an example of the present disclosure.

Figure 16C:
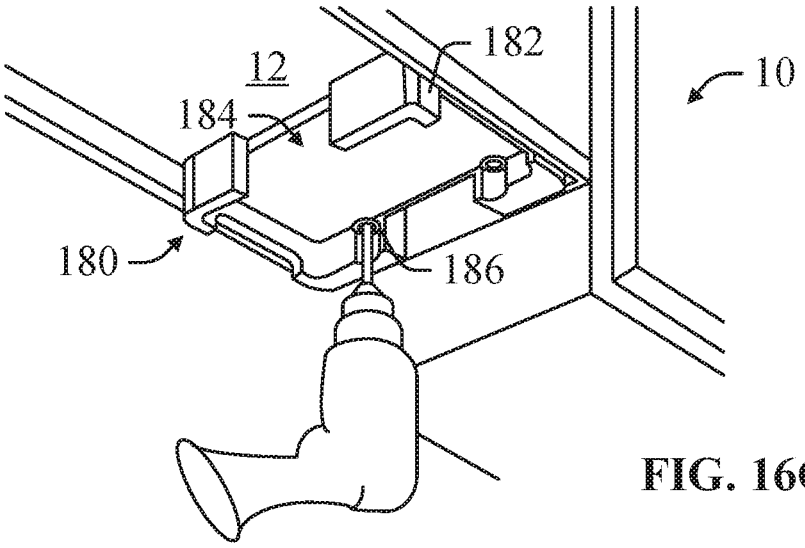

FIG. 16C is a perspective view of the packing shim being mounted to a cabinet according to an example of the present disclosure.

Figure 17A:
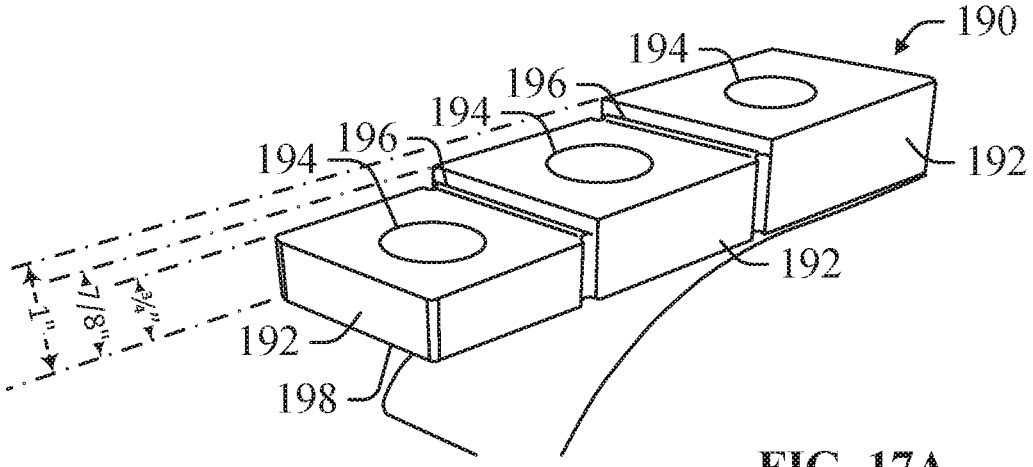

FIG. 17A is a perspective view of a shim assembly according to an example of the present disclosure.

Figure 17B:
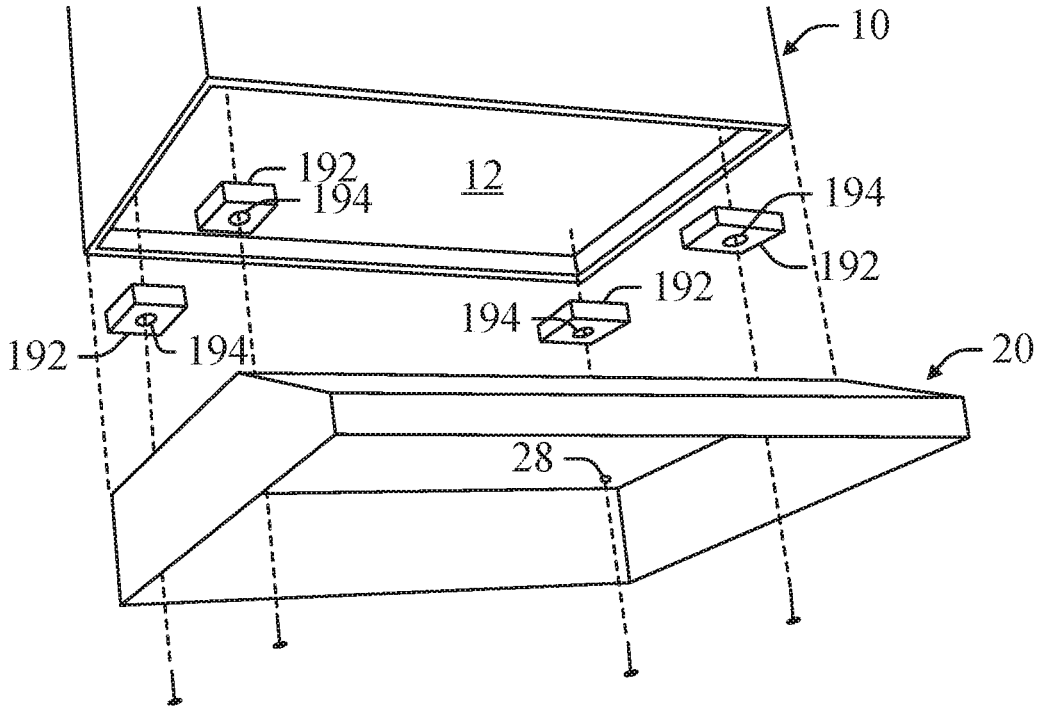

FIG. 17B is a perspective view of mounting a range hood to a cabinet with a plurality of shim elements according to an example of the present disclosure,

DETAILED DESCRIPTION

Figure 1:
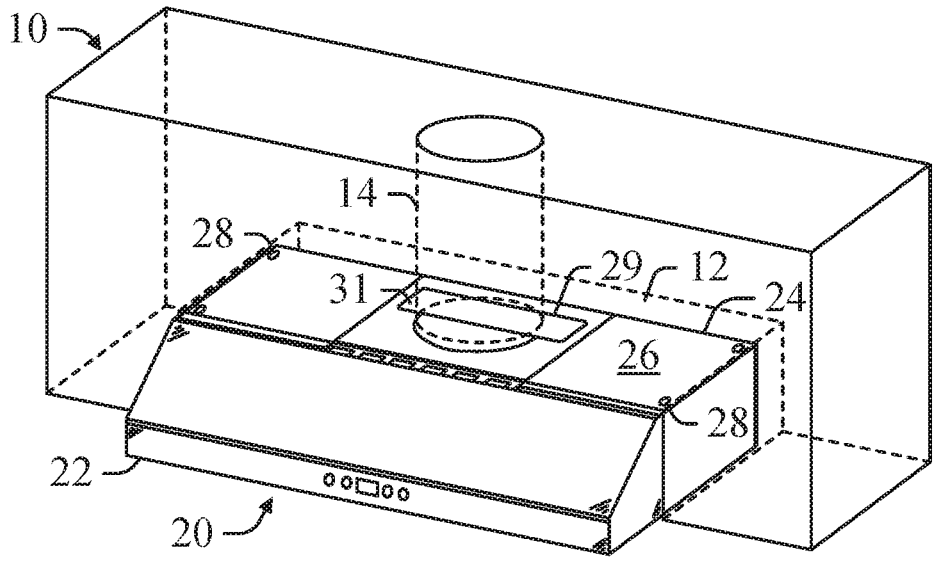
FIG. 1 is a schematic diagram of a range hood mounted to a underside mounting position of a cabinet.
Figure 2A:
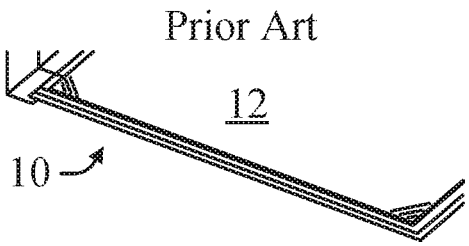
FIG. 2A is a representative underside mounting surface of a frameless cabinet.
Figure 2B:
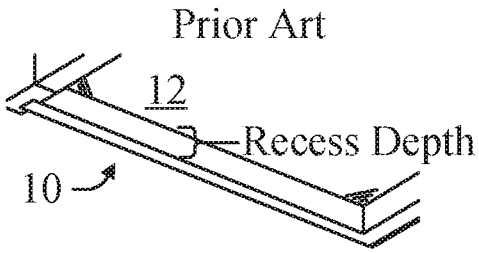
FIG. 2B is a representative underside mounting surface of a framed cabinet.

As depicted in FIG. 1, a range hood 20, according to an example of the present disclosure, can include a nose section 22 and a base section 24 mountable to an underside mounting surface 12 of a cabinet 10 or other support structure such that a nose section 22 extends from the cabinet 10. The base section 24 can have a planar upper surface 26 for interfacing with a planar portion of the underside mounting surface 12. The cabinet 10 can comprise European "frameless" configuration in which the underside mounting surface 12 is flush or nearly flush with the edges of the sides of the cabinet 10 as depicted in FIG. 2A. The cabinet 10 can comprise a framed configuration in which the underside mounting surface 12 is recessed from the edges of the sides of the cabinet 10 as depicted in FIG. 2B. The planar upper surface 26 can include at least one mounting feature 28 for receiving a fastener that can be sunk into the underside mounting surface 12 to secure the base section 24 to the cabinet 10. In an example, the planar upper surface 26 can include a duct port 29 for interfacing with ducting 14 extending through the cabinet 1.0, At least one duct panel 31 can be positioned within the duct port. 29.

As depicted in FIGS. 3A-3C and 4A-4C, a mounting plate 30, according to an example of the present disclosure, can assist, in the mounting of the range hood 20 to the cabinet 10. The mounting plate 30 can include a base portion 32 defining at least one hood opening 36 and including at least one support feature 38 for interfacing with the upper surface 26 of the range hood 20.

Figure 3A:
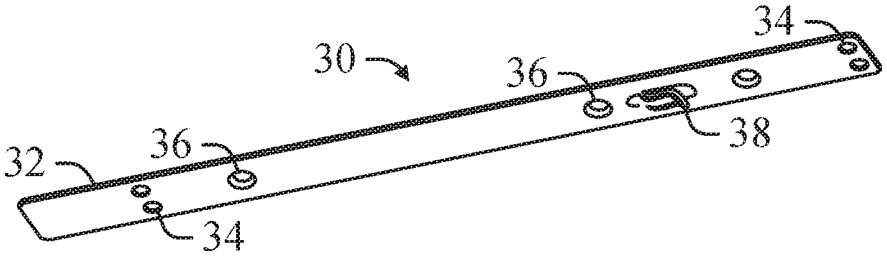
FIG. 3A is a perspective view of a mounting bracket for mounting a range hood to a frameless cabinet according to an example of the present disclosure.
Figure 3B:
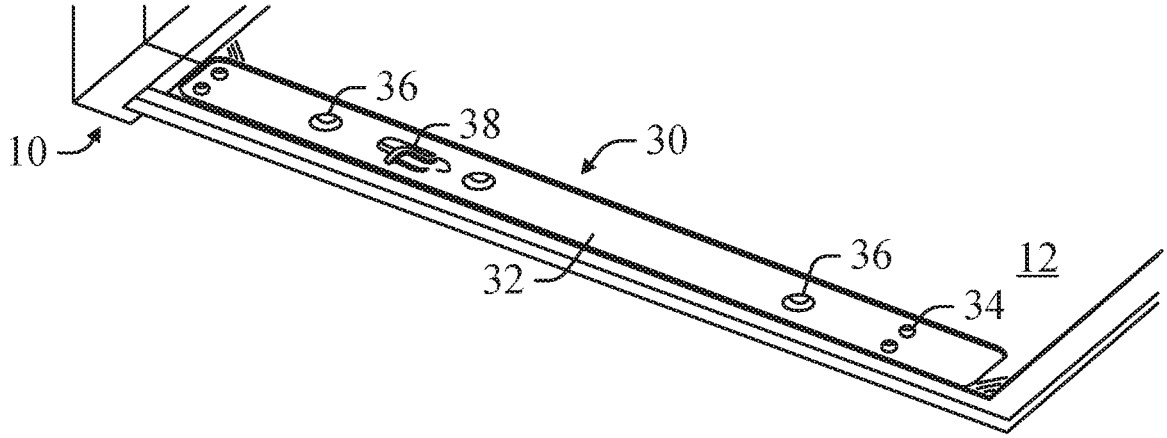
FIG. 3B is a perspective view of the mounting bracket depicted in FIG. 3A mounted to a frameless cabinet according to an example of the present disclosure.
Figure 3C:
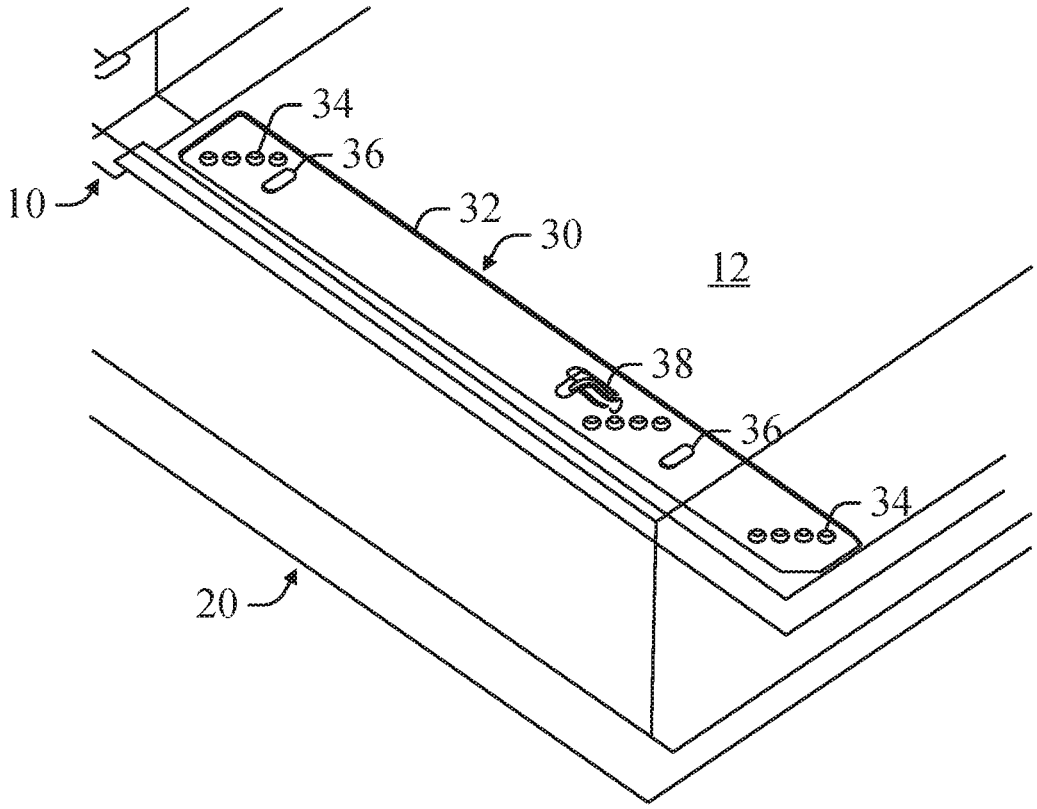
FIG. 3C is a perspective view of the mounting bracket depicted in FIG. 3A mounted to a frameless cabinet and supporting a range hood according to an example of the present disclosure.

As depicted in FIGS. 3A-3C, in an example, the base portion 32 can include at least one positioning opening 34 for receiving a fastener for securing the mounting plate 30 to the underside mounting surface 12 of a frameless cabinet 10. In this configuration, the base portion 32 is oriented parallel to the underside mounting surface 12 of the cabinet 10 and the upper surface 26 of the range hood 20 as illustrated in FIG. 3C. In an example, the positioning openings 34 can be staggered to allow the fasteners to be sunk in different positions on the underside mounting surface 12.

Figure 4A:
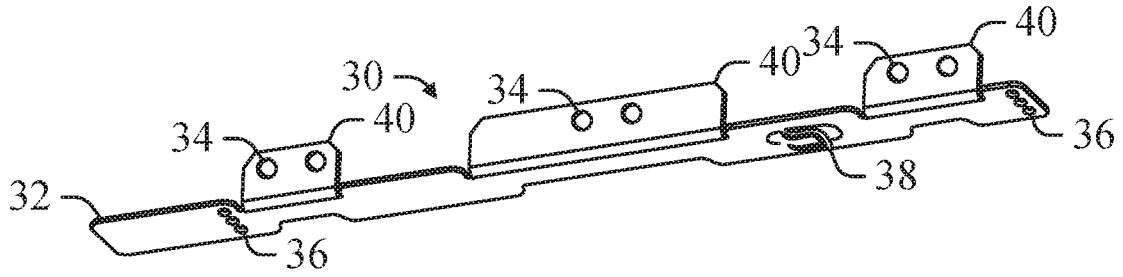
FIG. 4A is a perspective view of a mounting bracket for mounting a range hood to a framed cabinet according to an example of the present disclosure.
Figure 4B:
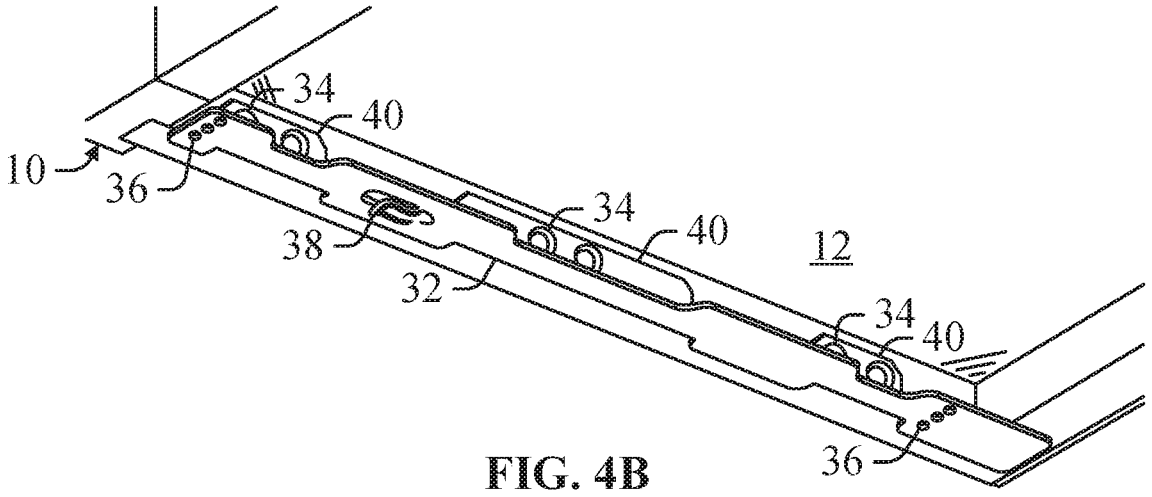
FIG. 4B is a perspective view of the mounting bracket depicted in FIG. 4A mounted to a framed cabinet according to an example of the present disclosure.
Figure 4C:
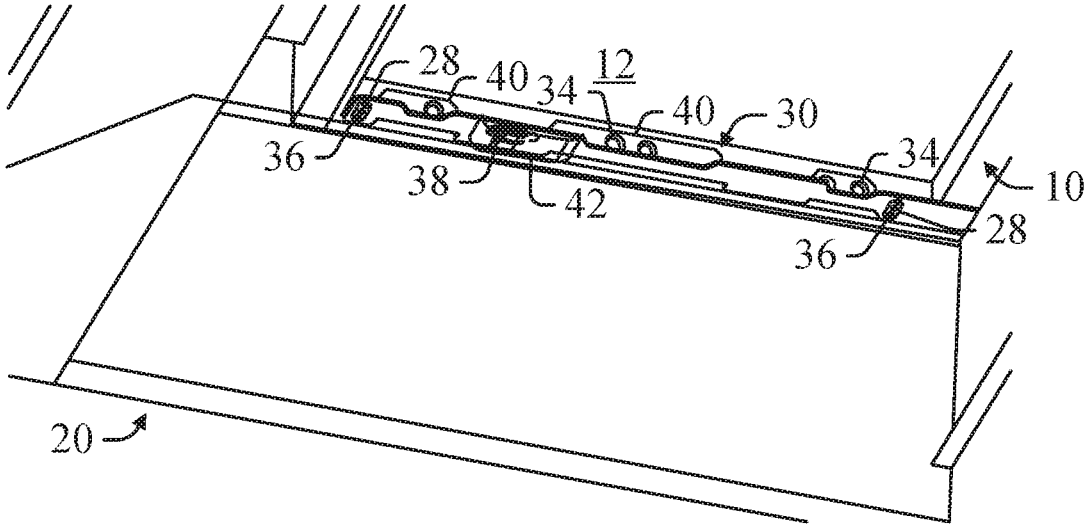
FIG. 4C is a perspective view of the mounting bracket depicted in FIG. 4A mounted to a framed cabinet and supporting a range hood according to an example of the present disclosure.

As depicted in FIGS. 4A-4C, in an example, the mounting plate 30 can include at least one trim tab 40 oriented transverse to the base portion 30 and configured for attachment to a framed cabinet 10. In this configuration, each trim tab 40 can include at least one positioning opening 34 for receiving a fastener to secure the trim tab 40 to a portion of the frame encircling the underside mounting surface 12. In this configuration, the trim tab 40 orients the base portion 32 parallel to the underside mounting surface 12 of the cabinet 10 and the upper surface 26 of the range hood 20 as illustrated in FIG. 4C. In an example, the trim tab 40 can be sized such that the base portion 32 is flush with the edge of the frame encircling the underside mounting surface 12 reducing the need for shims to account for the recess depth created by the frame.

During installation, the mounting plate 30 can be initially positioned on the cabinet 10 and secured by inserting fasteners through the corresponding positioning openings 34 in either the frame or the underside mounting surface 12. The smaller mounting plates 30 can be more easily aligned and correctly positioned on the underside mounting surface 12 than the larger and heavier range hood 20 as illustrated in FIGS. 3B and 4B. After securing the mounting plate 30, the upper surface 26 of the range hood 20 can be positioned against the base portion 32 of the mounting plate 30. The hood openings 36 can receive a fastener inserted through a corresponding mounting feature 28 of the range hood 20 and sunk into the underside mounting surface 12. In framed cabinets where the trim tabs 40 position the base portion 30 flush with the edge of the frame, the fastener can be inserted through the hood openings 36 without being sunk into the underside mounting surface 12. In this configuration, the trim tabs 40 coupled to the frame operably couple the range hood 20 to the cabinet 10.

The hood openings 36 can be positioned on the base portion 32 such that the hood openings 36 are spaced and positioned to correspond to the dimensions and support weight of the range hood 20, The smaller mounting plates 30 can be more easily positioned and aligned on the underside mounting surface 12 than the larger and heavier range hood 20 as illustrated in FIG. 3B. In this configuration, the hood openings 36 of the properly positioned mounting plates 30 can guide drilling of the pilot holes for sinking of the fasteners for the range hood 20. As illustrated in FIG. 3C, in an example, the hood openings 36 can be oversized to allow for small misalignments between the cabinet 10 and the range hood 20.

As depicted in FIGS. 3C and 4C, the range hood 20 can define at least one support opening 42 on the upper surface 26 of the range rood 20 for interfacing with a corresponding support feature 38. The support feature 38 can be configured to hook the range hood 20 at the support opening 42 to operably engage the range hood 20 to the mounting plate 30. The mounting plate 30 can be first mounted to the cabinet 10 before the range hood 20 is lifted to engage the support features 38 to the support openings 42. The support feature 38 can support the weight of the range hood 20 until the fasteners can be inserted through the hood openings 36 to secure the range hood 20 to the mounting plate 30 and the underside mounting surface 12. An installer can then make the necessary connections for the range hood and insert the fasteners without the added burden of supporting the weight of the range hood 20. As depicted in FIG. 1, in an example, the range hood 20 can include a cutout 27 through which wires can be drawn to make the electrical connections of the range hood 20. Similarly, the support features 38 can be positioned such that the mounting features 28 of the upper surface 26 of the range hood 20 are aligned with the hood openings 36 when the support features 38 are coupled to the support openings 42. The exemplary embodiment support feature 38 depicted in FIGS. 3A-3C comprises a tongue formed from material of the base portion and displaced from the base portion to define a void in the base portion. That tongue has a proximal end extending from the base portion to a distal end displaced from the base portion a distance that is greater than a thickness of the base section of the range hood. Additionally, the tongue proximal end extends away from the base section and continues to a tongue crest. The tongue then extends from the crest to a trough and then from the trough to the distal end of the tongue. The crest is displaced from the base portion and the trough is not farther from the base portion than the base section thickness. The distal end of the tongue is displaced from the base portion a distance greater than the thickness of the base section of the range hood. The distal end of the at least one tongue is configured to be inserted through the support opening of the range hood base section to hook the range hood as the range hood is moved from the distal end of the at least one tongue toward the proximal end of the at least one tongue.

Figure 5:
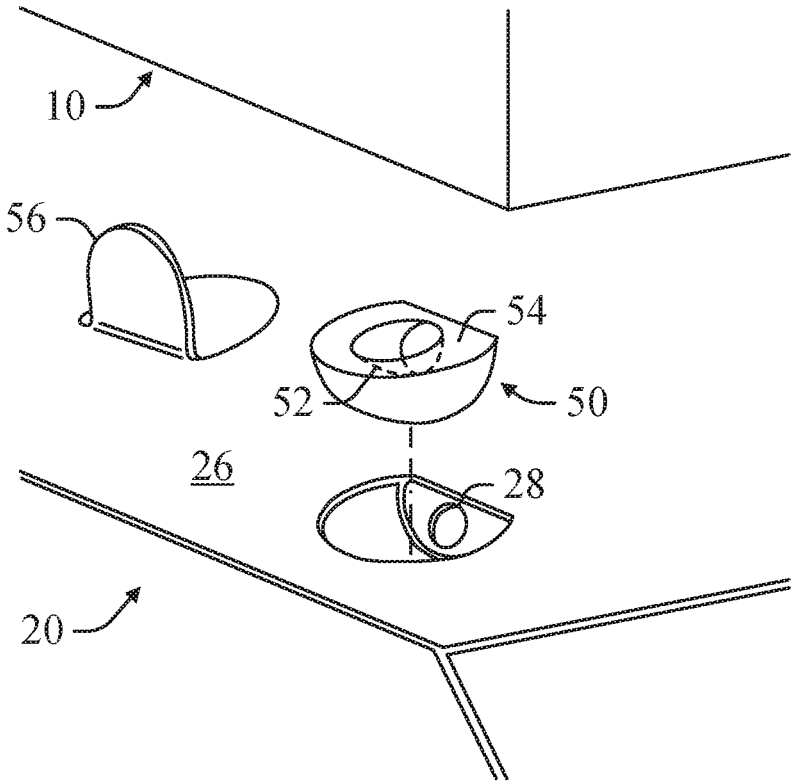
FIG. 5 is a perspective view of a range hood and a screw/drill guide configured to receive angled fasteners according to an example of the present disclosure.
Figure 6A:
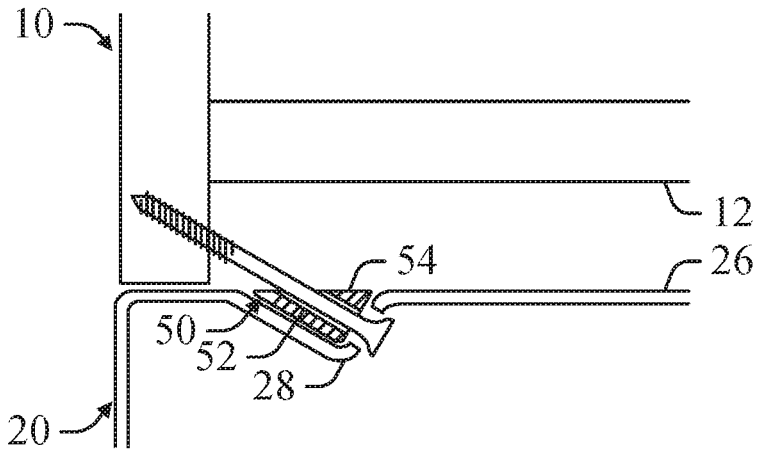
FIG. 6A is a side view of the range hood and screw/drill guide depicted in FIG. 5 illustrating sinking of the angled fastener into a framed cabinet according to an example of the present disclosure.
Figure 6B:
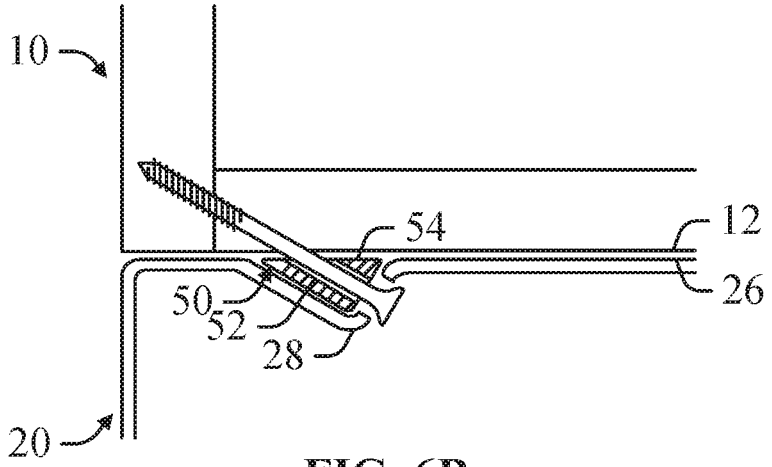
FIG. 6B is a side view of the range hood and screw/drill guide depicted in FIG. 5 illustrating sinking of the angled fastener into a frameless cabinet according to an example of the present disclosure.

As depicted in FIGS. 5 and 6A-6B, in an example, the upper surface 26 of the range hood 20 at the mounting features 28 can be recessed to orient the mounting feature 28 to receive fasteners angled transverse to the upper surface 26 of the range hood 20. The range hood 20 can include a screw/drill guide 50 that can be inserted into the recess at the mounting feature 28, each screw/drill guide 50 defining a guide hole 52 and a planar surface 54, The guide hole 52 is positioned to align with angled mounting feature 28 when the screw/drill guide 50 is inserted into the recess to extend the effective length of the mounting feature 28 and guide drill bits or screws inserted through the mounting feature 28. The planar surface 54 can be oriented to align with the upper surface 26 of the range hood 20 when the screw/drill guide 50 is inserted into the recess to present a continuous upper surface 26.

During installation, the range hood 20 can be positioned against the cabinet 10 and screws can be inserted through the corresponding mounting feature 28 and the guide hole 52 of the range hood 20 and sunk into the cabinet 10, For frameless cabinets 10, the upper surface 26 of the range hood 20 can be positioned against the underside mounting surface 12. The fastener can then inserted through the mounting feature 12 and sunk into the underside mounting surface 12 transverse to the plane of the underside mounting surface 12 as illustrated in FIG. 6A. The angling of the fastener can allow longer fasteners to be used than fasteners sunk perpendicular to the underside mounting surface 12. In an example, the mounting feature 28 and guide hole 52 can be oriented such that the fastener angled between about 20 and about 40 degrees offset from the upper surface 26 of the range hood 20. In another example, the fastener is angled at about 30 degrees offset from the upper surface 26 of the range hood 20. For framed cabinets 10, the upper surface 26 of the range hood 20 can be positioned against the frame. The fastener can then inserted through the mounting feature 12 and sunk into the frame transverse to the plane of the underside mounting surface 12 as illustrated in FIG. 6B.

As illustrated in FIG. 5, in an example, the upper surface 26 of the range hood 20 can include at least one locating tab 56 that can be folded to extend outwardly from the upper surface 26 of the range hood 20. In this configuration, the locating tab 56 can be positioned against the frame of the framed cabinet 10 to align the range hood 20 with the frame for inserting the fastener through mounting feature 28 and sinking the fastener into the frame.

Figure 7A:
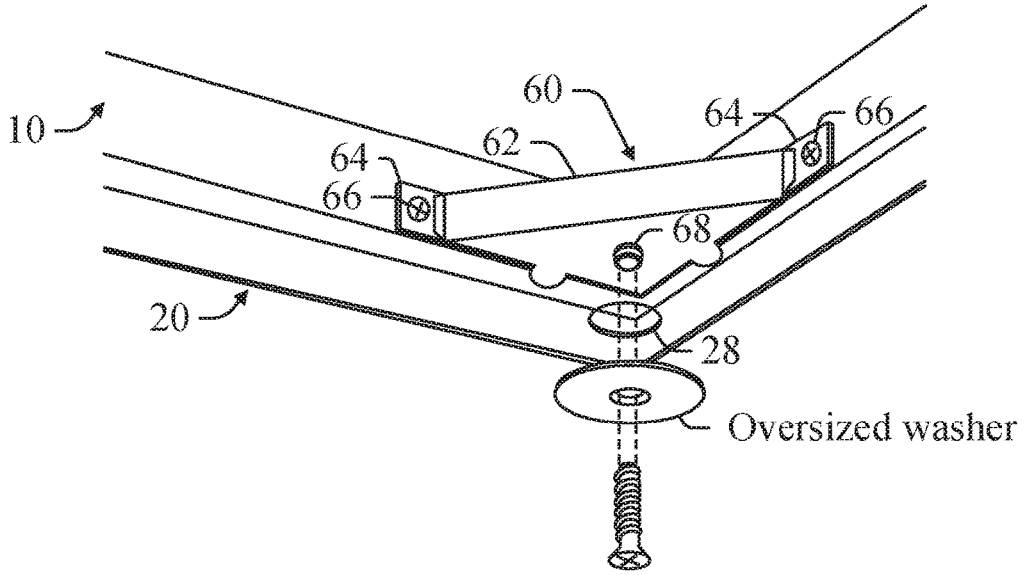
FIG. 7A perspective view of a corner brackets mounted to a framed cabinet according to an example of the present disclosure.
Figure 7B:
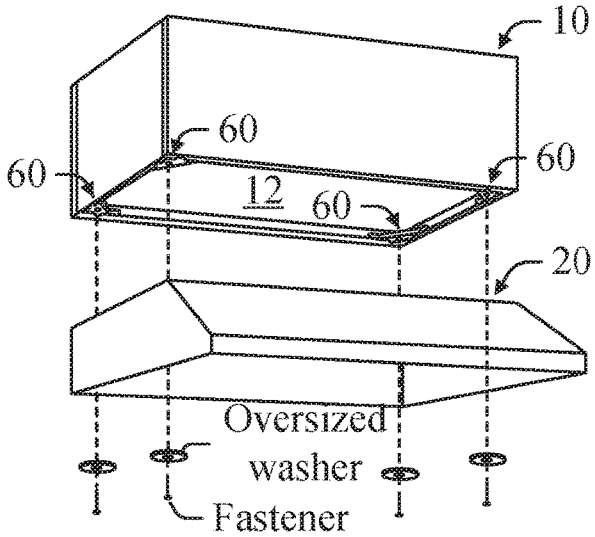
FIG. 7B is a perspective view illustrating mounting of a range hood to a cabinet by a plurality of corner brackets according to an example of the present disclosure.
Figure 7C:
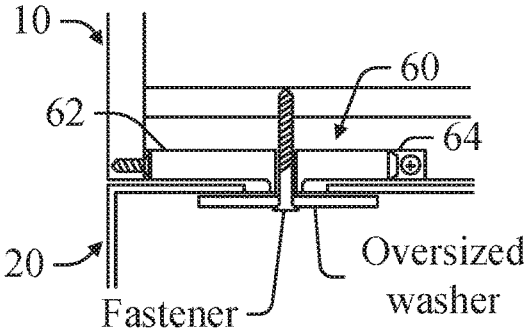
FIG. 7C is a side view of the mounting of a range hood to the framed cabinet by the corner bracket depicted in FIG. 7A according to an example of the present disclosure.

As depicted in FIGS. 7A-7C, at least one corner bracket 60 can mount a range hood 20 to a framed cabinet 10 without the use of shims or spacers. Each corner bracket 60 can include a main body 62 and at least one frame tab 64 extending from the main body 62, Each frame tab 64 can include a positioning hole 66 for receiving a fastener to mount the frame tab 64 and the main body 62 to the frame of framed cabinet 10. In an example, the corner bracket 60 can include at least two perpendicular frame tabs 64 such that the corner bracket 60 can be mounted in a corner of the frame as illustrated in FIG. 7A. The corner bracket 60 can be mounted on the frame such that the bottom of the corner bracket 60 is generally flush with the bottom edge of the frame without the use of shims or spacers.

The main body 62 can define a hood hole 68 for receiving a fastener inserted through a mounting feature 28 of the range hood 20. The fastener can be secured to the main body 62 or the hood hole 66 can act as a guide for sinking the fastener into the underside mounting surface 12 as illustrated in FIG. 7B. As depicted in FIG. 7A, in an example, the mounting feature 28 can comprise an oversized hole having a diameter exceeding the diameter of the fastener to permit discrete adjustments of the range hood 20 to align the range hood 20 with the cabinet 10. In this configuration, the range hood 20 can include at least one oversized washer having an outer diameter exceeding the diameter of the oversized hole of the mounting feature 28.

Figure 8A:
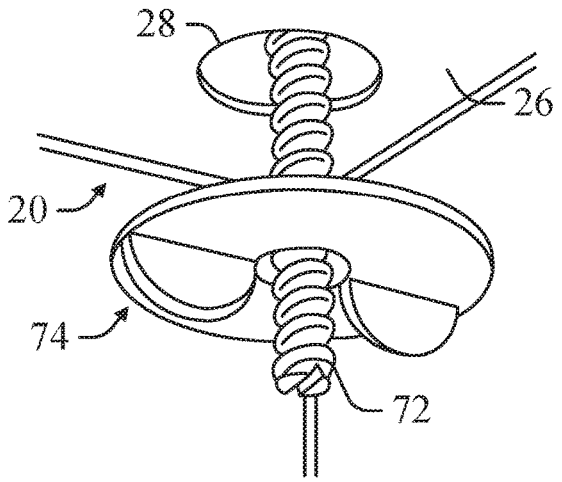
FIG. 8A is a perspective view of a mounting feature having an oversized hole for receiving a threaded fastener engagable to an oversized nut for retaining a range hood according to an example of the present disclosure.
Figure 8B:
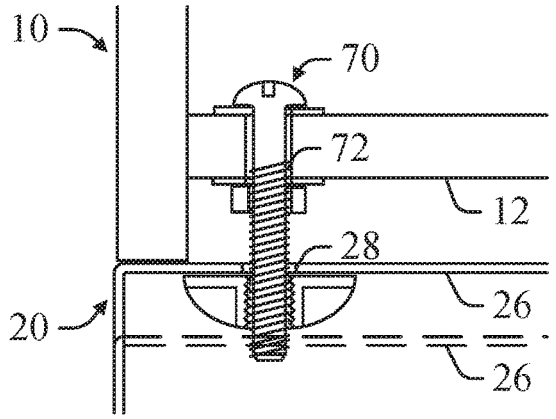
FIG. 8B is a side view of a mounting feature having an oversized hole for receiving a threaded fastener engagable to an oversized nut for retaining a range hood according to an example of the present disclosure wherein the threaded fastener is a bolt inserted through the cabinet.
Figure 8C:
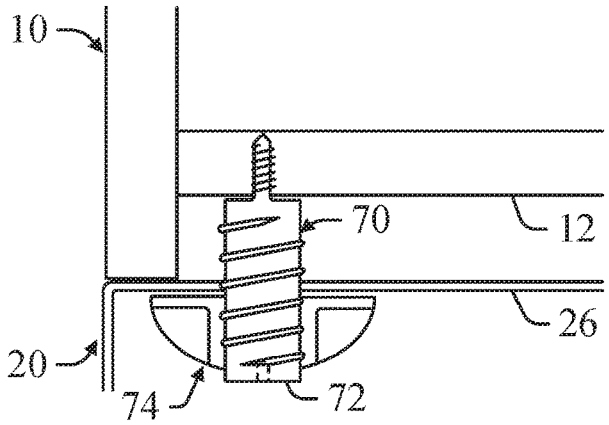
FIG. 8C is a side view of a mounting feature having an oversized hole for receiving a threaded fastener engagable to an oversized nut for retaining a range hood according to an example of the present disclosure wherein the threaded fastener has a second threaded portion sinkable into the cabinet.
Figure 8D:
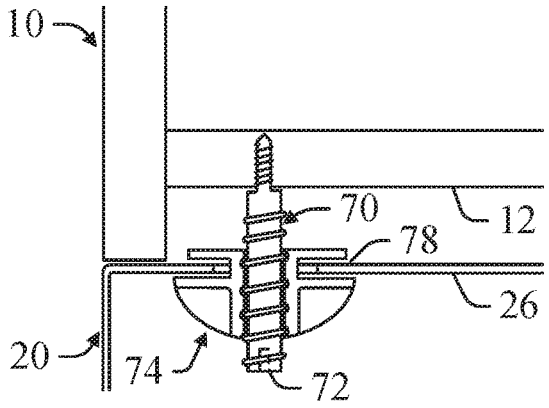
FIG. 8D is a side view of a mounting feature having an oversized hole for receiving a threaded fastener engagable to an oversized nut for retaining a range hood according to an example of the present disclosure wherein the oversized nut includes a slot for integrating the nut into the mounting feature of the range hood.

As depicted in FIGS. 8A-8D, in an example, the mounting feature 28 can comprise an oversized hole having a diameter exceeding the diameter of the fastener to permit discrete adjustments of the range hood 20 to align the range hood 20 with the cabinet 10. In this configuration, a fastener 70 having a threaded shaft. 72 and an outer diameter less than the diameter of the oversized hole can be inserted through the oversized hole of the mounting feature 28. The fastener 70 can be attached to the mounting surface 12 of the cabinet 10 such that the fastener 70 extends from the underside mounting surface 12 of the cabinet 10. As depicted in FIG. 8B, the fastener 70 can be mounted a bolt inserted through a hole the underside mounting surface 12 of the cabinet 10 such that the threaded shaft 72 extends outward from the underside mounting surface 12 and can be inserted through the oversized hole of the mounting feature 28. As depicted in FIGS. 8C-8D, the threaded fastener 70 can include a second threaded portion 73 that can be sunk into the underside mounting surface 12 to secure the threaded fastener 70 to the underside mounting surface 12.

As depicted in FIG. 8A, a nut 74 having a threaded bore 76 for receiving the threaded shaft 72 and having an outer diameter greater than the diameter of the oversized hole can be engaged to the fastener 70. The nut 74 can be tightened to engage the range hood 20 and secure the range hood 20 against the cabinet 10. As depicted in FIG. 8C, in an example, the nut 74 can include circumferential slot 78 for positioning the nut 74 within the oversized opening of the mounting feature 28. In this configuration, tightening the nut 74 lifts the range hood 20 and secures the range hood 20 to the cabinet 10.

Figure 9A:
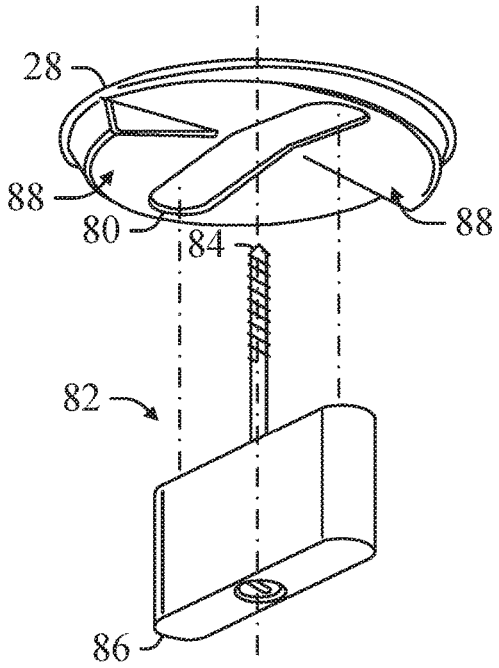
FIG. 9A is a perspective view of a mounting feature for a range hood having an elongated slot keyed to a toggle portion of a toggle fastener according to an example of the present disclosure.
Figure 9B:
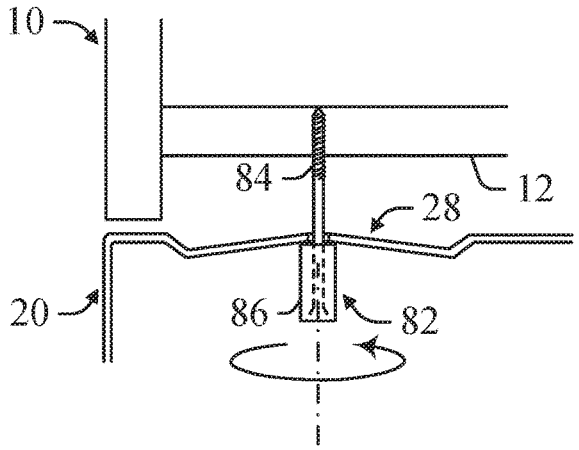
FIG. 9B is a side view of the mounting feature depicted in FIG. 9A illustrating engagement of a ramped portion of the mounting feature with the toggle portion to elevate the range hood according to an example of the present disclosure.
Figure 9C:
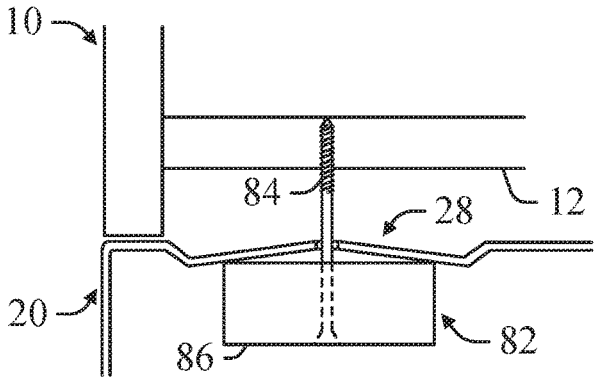
FIG. 9C is a side view of the mounting feature depicted in FIG. 9A illustrating engagement of a ramped portion of the mounting feature with the toggle portion to couple the range hood to a cabinet according to an example of the present disclosure.

As depicted in FIGS. 9A-9C, in an example, the mounting feature 28 can comprise an elongated slot 80. In this configuration, a toggle fastener 82 having a threaded portion 84 and a toggle portion 86 shaped to correspond to the elongated slot 80 can be used to secure the range hood 20 to the cabinet 10.

During installation, the threaded portion 84 of the toggle fastener 82 can be sunk into the underside mounting surface 12 of the cabinet 10. The range hood 20 can then be lifted and the elongated slot 80 of the corresponding mounting features 28 can be aligned with the toggle portion 86 such that the toggle portion 86 can be inserted through the elongated slot 80. As depicted in FIG. 9B, the toggle fastener 82 can then be rotated such that the toggle portion 86 is misaligned with the elongated slot 80 preventing the toggle portion 86 from being withdrawn through the elongated slot 80 and decoupling the range hood 20 from the cabinet 10.

As depicted in FIG. 9A, in an example, the mounting feature 28 can include at least one ramped portion 88 adjacent the elongated slot 80, In this configuration, rotating the toggle portion 86 engages the toggle portion 86 to the ramped portion 88 to further elevate the range hood 20 and pressing the range hood 20 against the cabinet 10 as illustrated in FIG. 9C.

As depicted in FIGS. 10A-10D, in an example, an adjustable spacer 90 can be mounted to the upper surface 26 of the range hood 20 for mounting a range hood 20 to a framed cabinet 10. The adjustable spacer 90 can include a base portion 92 and a stacked portion 94 including a plurality of spacer segments 96. The base portion 92 can be mounted on the upper surface 26 of the range hood 20 such that the stacked portion 94 extends above the upper surface 26, In an example, the base portion 92 can include adhesive backing 93 for mounting the base portion 92 to the upper surface 26 of the range hood 20, The individual spacer segments 96 can be removed such that the length of the stacked portion 94 corresponds to the recess depth created by the frame extending around the underside mounting surface 12. In an example, the upper surface 26 of the range hood 20 can be recessed such that the base portion 92 is flush with the upper surface 26 of the range hood 20.

As depicted in FIG. 10D, in an example, the adjustable space 90 can be mounted to the upper surface 26 of the range hood 20 at the mounting feature 28. In this configuration, the adjustable spacer 90 can include a guide hole 98 extending through the base portion 92 and the stacked portion 94. The appropriate number of spacer segments 96 can be removed such that the effective length of the stacked portion 94 corresponds to the recess depth created by the frame, A fastener can be inserted through the mounting feature 28 and into the underside mounting surface 12 of the cabinet 10.

As depicted in FIGS. 11A-B, a mounting bracket 100 having a base portion 102 and at least one slotted stud 104 can be mounted to the underside mounting surface 12. The base portion 102 can be mounted to the underside mounting surface 12 such that the slotted studs 104 extend downward from the underside mounting surface 12 of the cabinet 10, In an example, a fastener can be inserted through each slotted stud 14 and the base portion 102 to mount the mounting bracket 100 to the cabinet 10.

As depicted in FIGS. 11A-B, the mounting feature 28 can comprise a slider 106 that can be slide to engage a slot of the slotted stud 104 inserted through the opening in the upper surface 26 of the range hood 20. During mounting, the range hood 20 can be positioned against the cabinet 10 such that the slotted stud 104 extends through the opening in the upper surface 26 of the range hood 20. The slider 106 can be slid to engage the corresponding slot of the slotted stud 104 to mount the range hood 20 to the cabinet 10. The slotted stud 104 allows the range hood 20 to be mounted to the cabinet 10 at different relative heights.

As depicted in FIGS. 11A-B, in an example, the range hood 20 can include a ramp portion 108 at the mounting feature 28 that deflects the slider 106 as the slide 106 is slid into engagement with the slotted stud 104. The deflection of the slider 106 prevents inadvertent disengagement of the slider 106 from the slotted stud 104 and presses the range hood 20 against the cabinet 10.

As depicted in FIGS. 12A-B, in an example, a mounting bracket 110 having a base portion 112 and a mounting tab 114 can be mounted to the underside mounting surface 12 of the cabinet 10. The mounting tab 114 can include at least one positioning opening 116 for receiving a fastener for securing the mounting bracket 110 to the underside mounting surface 12 of a frameless cabinet 10. The mounting tab 114 can extend transversely from the base portion 112 include a plurality of angled notches 118 arranged across the length of the mounting tab 114.

The range hood 20 can include a hood bracket 120 positioned within the mounting feature 28 of the range hood 20, the hood bracket 120 defining an opening 122 for receiving the mounting tab 114. An engagement feature 124 can be positioned within opening 122 to engage an angled notch 118 to mount the range hood 20 to the cabinet 10, The plurality of angled notches 118 allow the range hood 20 to be positioned at different heights relative to the cabinet 10. In an example, this arrangement allows the range hood 20 can be lifted against the frame of a framed cabinet 10 as depicted in FIGS. 12C-12D.

As depicted in FIGS. 13A-D, in an example, a mounting bracket 130 having a base portion 132 and a plurality of mounting tabs 134 can be mounted beneath the cabinet 10 to wall studs 14 behind the cabinet 10. The base portion 132 can include at least one positioning opening 136 for receiving a fastener for securing the base portion 132 below the underside mounting surface 12 of a cabinet 10. Mounting the base portion 132 to the wall studs 14 orients the mounting tabs 134 parallel to the underside mounting surface 12 of the cabinet 10.

As depicted in FIGS. 13B-D, the range hood 20 can include a rear portion 138 defining at least one bracket opening 140 and including hood tab 142. The hood tabs 142 are oriented parallel to underside mounting surface 12 and the mounting tabs 134. In this configuration, the range hood 20 can be maneuvered such that the mounting tabs 134 are each inserted through the corresponding bracket opening 140 and engaged to the hood tab 142. A fastener 144 can be inserted through the overlapping mounting and hood tabs 134, 142 to mount the rear portion of the range hood 20 to the cabinet 10. As illustrated, the mounting bracket 130 can operate as a pivot supporting the base section 24 while the nose section 22 can be pivoted into engagement to the cabinet 10 for receiving fasteners to couple the range hood 20 to the cabinet 10 as illustrated in FIG. 13E, As depicted in FIGS. 14A-C, in an example, a mounting bracket 150 having a mounting portion 152 and a support bracket 154. The mounting bracket 150 can be mounted beneath the cabinet 10 to the wall behind the cabinet 10 such that the mounting bracket 150 is positioned beneath the cabinet 10. The mounting portion 152 can include at least one positioning opening 156 for receiving a fastener for securing the mounting portion 152 to the wall beneath the cabinet 10 such that the support bracket 154 is generally parallel to the underside mounting surface 12. The base portion 22 of the range hood 20 can be rested on the support bracket 154 to support range hood 20 as fasteners are sunk through mounting features 28 of the range hood 20 into the underside mounting surface 12 of the cabinet 10. The mounting bracket 150 can include an engagement tab 158 insertable into a slot defined by the range hood 20, As depicted in FIG. 14C, the engagement tab 158 can be bent after insertion through the slots to couple the range hood 20 to the mounting bracket 150.

As depicted in FIG. 15A-B, in an example, a mounting hook 160 can be coupled to a support feature 162 on the range hood 20 for supporting the range hood 20 while fasteners are inserted through the mounting features 28 of the range hood 20. The mounting hook 160 can include a threaded portion 164 and a hook element 166. The threaded portion 164 can be sunk into the cabinet 10 such that the hook element 166 extends from the cabinet 10. The support feature 162 can define a recess 168 and an engagement portion 170 such that the hook element 166 can be inserted into the recesses 168 and engage the engagement portion 170 to engage the range hood 20 to the cabinet 10.

As depicted in FIGS. 16A-C, in an example, a packing shim 180 having legs 182 defining at least one slot 184 for receiving the range hood 20. The packing shim 180 can support the range hood 20 within a packing box to prevent movement of the range hood 20 within the packing box. The packing shim 180 can define at least one mounting feature 186 for receiving a fastener to secure the packing shim 180 to the cabinet 10 at the underside mounting surface 12. In an example, a shim anchor 188 can be received within the mounting feature 186 to prevent the fastener from tearing or compromising the integrity of the packing shim 180. The packing shim 180 can comprise Styrofoam, plywood or other conventional packing materials.

As illustrated in FIG. 16C, the packing shim 180 can be mounted to the underside mounting surface 12, wherein the legs 182 are sized such that the ends of the legs 182 are flush with the edges of the frame or extend past the frame. In this configuration, the range hood 20 can be mounted to the legs 182 of the pacing shim 180 such that that the range hood 20 is flush with the frame or generally aligned with the cabinet 10.

As depicted in FIGS. 17A-B, in an example, the range hood 20 can be provided with at least one shim assembly 190 that includes a plurality of shim elements 192. Each shim element 192 defines a mounting feature 194 for receiving a fastener to mount the shim element 192 to the cabinet 10 at the underside mounting surface 12. The plurality of shim elements 192 can be connected to an adjoining shim element 192 with a frangible portion 196 such that the frangible portion 196 can be tom to separate the shim elements 192. In an example, the plurality of shim elements 192 can have an adhesive surface 198 for securing the shim element 192 to top surface 26 of the range hood 20.

As illustrated in FIG. 17A, the plurality of shim elements 192 can comprise a different height, from the other shim elements 192 of the plurality of shim elements 192. In an example, the plurality of the shim elements 192 can have incrementally increasing heights. In this configuration, the appropriate shim element 192 can be mounted to the underside mounting surface 12 to provide an even surface for mounting the range hood 20. A fastener can be inserted through the mounting feature 28 of the range hood 20 and the mounting feature 194 of the corresponding shim element 192 to mount the range hood 20 to the cabinet 10.

VARIOUS NOTES & EXAMPLES

Example 1 is a range hood mountable to an underside mounting surface of a cabinet, comprising: a base section having an upper surface and defining at least one support opening positioned on the upper surface; and a mounting plate mountable to the cabinet at the underside mounting surface and including a base portion having at least one support feature configured to be inserted through the corresponding support opening to engage the upper surface of the base portion to hold the base portion proximate to the cabinet before being secured thereto by at least one fastener.

In Example 2, the subject matter of Example 1 optionally includes wherein the base portion of the mounting plate comprises at least one hood opening configured to receive a fastener inserted through a mounting feature of the base section to operably couple the range hood to the mounting plate; wherein the support feature couples the range hood to the mounting plate as the fastener is inserted through the range hood and the base portion.

In Example 3, the subject matter of Example 2 optionally includes wherein the at least one hood opening guides the fastener inserted through the mounting feature to the underside mount surface such that the fastener is configured to be sunk into the underside mounting surface to couple the range hood to the cabinet.

In Example 4, the subject matter of any one or more of Examples 1-3 optionally include wherein the base portion of the mounting plate defines at least one positioning opening for receiving a fastener configured to he sunk into the underside mounting surface of the cabinet to couple the mounting plate to the cabinet.

In Example 5, the subject matter of any one or more of Examples 1-4 optionally include wherein the base portion of the mounting plate, further includes: at least one trim tab extending transversely from the base portion and configured to contact a frame portion encircling the underside mounting surface of the cabinet for aligning the base section with the underside mounting surface.

In Example 6, the subject matter of Example 5 optionally includes wherein each trim tab defines at least one positioning opening for receiving a fastener configured to be sunk into the frame portion such that the base portion is oriented parallel to the underside mounting surface of the cabinet and the upper surface of the base portion.

In Example 7, the subject matter of Example 6 optionally includes wherein the at least one trim tab is mounted on the frame such that the base portion is flush with an edge of the frame portion.

In Example 8, the subject matter of any one or more of Examples 1-7 optionally include wherein the at least one support feature comprises at least one of a hook element and a clip element.

Example 9 is a mounting plate for mounting a range hood to an underside mounting surface of a cabinet, comprising: a base portion having at least one support feature; wherein the at least one support feature is configured to be inserted through a support, opening defined in an upper surface of the range hood to support the base portion at a position proximate to the cabinet before being secured thereto by at least one fastener.

In Example 10, the subject matter of Example 9 optionally includes wherein the base portion further comprises: at least one range hood opening configured to receive a fastener inserted through a mounting feature in the upper surface of the range hood to operably couple the range hood to the mounting plate; wherein the support feature couples the range hood to the mounting plate as the fastener is inserted through the range hood and the base portion.

In Example 11, the subject matter of Example 10 optionally includes wherein the at least one hood opening guides the fastener inserted through the mounting feature to the underside mount surface such that the fastener configured to be sunk into the underside mounting surface to couple the range hood to the cabinet.

In Example 12, the subject matter of any one or more of Examples 10-11 optionally include wherein the base portion defines at least one positioning opening for receiving a fastener configured to be sunk into the underside mounting surface of the cabinet to couple the mounting plate to the cabinet.

In Example 13, the subject matter of any one or more of Examples 10-12 optionally include wherein the base portion further comprises: at least one trim tab extending transversely from the base portion and configured to contact a frame portion encircling the underside mounting surface of the cabinet for aligning the range hood with the underside mounting surface.

In Example 14, the subject matter of Example 13 optionally includes wherein each trim tab defines at least one positioning opening for receiving a fastener configured to be sunk into the frame portion such that the base portion is oriented parallel to the underside mounting surface of the cabinet and the upper surface of the range hood.

In Example 15, the subject matter of Example 14 optionally includes wherein the at least one trim tab is mounted on the frame such that the base portion is flush with an edge of the frame portion.

In Example 16, the subject matter of any one or more of Examples 10-15 optionally include wherein the at least one support feature comprises at least one of a hook element and a clip element.

Example 17 is a method of mounting a range hood to an underside mounting surface of a cabinet, comprising: coupling a base portion of a mounting plate to the cabinet at the underside mounting surface, wherein the base portion includes at least one support feature; engaging the support feature to a support opening in an upper surface of the range hood such that the mounting plate supports the range hood and positions the range hood proximate the underside mounting surface; and inserting a fastener through a mounting feature in the upper surface of the range hood and through a hood opening in the base portion to couple the range hood to the mounting plate.

In Example 18, the subject matter of Example 17 optionally includes wherein the hood opening guides the fastener inserted through the mounting feature to the underside mount surface such that the fastener configured to be sunk into the underside mounting surface to couple the range hood to the cabinet.

In Example 19, the subject matter of any one or more of Examples 17-18 optionally include wherein coupling the base portion to the cabinet includes inserting a second fastener through at least one positioning opening defined in the base portion of the mounting plate, wherein the base portion is coupled to the underside mounting surface of the cabinet.

In Example 20, the subject matter of any one or more of Examples 17-19 optionally include wherein coupling the base portion to the cabinet includes inserting a second fastener through at least one positioning opening defined in a trim tab extending transversely from the base portion of the mounting plate.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

What is claimed is:

1. A range hood mountable to an underside mounting surface of a cabinet, comprising:

a range hood base section defining a thickness and having an upper surface defining at least one support opening, and a mounting plate mountable to the cabinet, the mounting plate comprising a base portion having at least one tongue, the tongue (i) having a proximal end extending from the base portion to a crest, (ii) extending from the crest to a trough, and (iii) extending from the trough to a distal end of the tongue which is displaced from the base portion a distance greater than the thickness of the base section of the range hood;

wherein the distal end of the at least one tongue is configured to be inserted through the support opening of the range hood base section to hook the range hood as the range hood is moved from the distal end of the at least one tongue toward the proximal end of the at least one tongue.

2. The range hood of claim 1, wherein the base portion of the mounting plate comprises at least one hood opening configured to receive a fastener inserted through a mounting feature of the base section to operably couple the range hood to the mounting plate.

3. The range hood of claim 2, wherein the at least one hood opening guides the fastener inserted through the mounting feature to the underside mount surface such that the fastener is configured to be sunk into the underside mounting surface to couple the range hood to the cabinet.

4. The range hood of claim 1, wherein the base portion of the mounting plate defines at least one positioning opening for receiving a fastener configured to be sunk into the underside mounting surface of the cabinet to couple the mounting plate to the cabinet.

5. The range hood of claim 1, wherein the base portion of the mounting plate defines at least one positioning opening for receiving a fastener.

* * * * *